United States Patent [19]

Gipperich

[11] 4,095,448

[45] Jun. 20, 1978

[54] ROLL HOUSING OF DIVIDED CONSTRUCTION WITH REMOVABLE HOUSING CAP

[75] Inventor: Theodor Gipperich, Dusseldorf, Germany

[73] Assignee: Schloeman-Siemag Aktiengesellschaft, Dusseldorf, Germany

[21] Appl. No.: 767,036

[22] Filed: Feb. 9, 1977

[30] Foreign Application Priority Data

Feb. 20, 1976 Germany ..... 2606842

[51] Int. Cl.[2] ..... B21B 31/08

[52] U.S. Cl. ..... 72/238; 72/245

[58] Field of Search ..... 72/238, 239, 245, 237, 72/21

[56] References Cited

U.S. PATENT DOCUMENTS 3,124,982 3/1964 Neumann ..... 72/21

3,217,525 11/1965 Howard ..... 72/237

3,733,870 5/1973 Diolot ..... 72/245

*Primary Examiner*—Milton S. Mehr

*Attorney, Agent, or Firm*—Holman & Stern

[57] ABSTRACT

In roll housings for rolling mills, it is desirable to be able to separate the top and bottom halves of the housing so as to be able to change the rolls. When the top and bottom halves are reassembled, they must be held firmly together to ensure correct operation of the rolling mill. It is proposed to have hydraulically-tensionable tie bars which are fixed in the lower half of the housing, and which grip the top of the upper half of the housing. Hydraulic fluid is applied to produce the tension, and the fluid pressure achieved is maintained throughout rolling operation. Such tie bars will normally be provided at at least four corners of a roll housing, and a single hydraulic circuit will supply fluid to all the bars. In addition, hydraulically operated jacks can be used to pivot the tie bars into and out of position, and these jacks can be operated from the same hydraulic circuit.

3 Claims, 3 Drawing Figures

ROLL HOUSING OF DIVIDED CONSTRUCTION WITH REMOVABLE HOUSING CAP

The invention relates to a roll housing of divided construction with a removable housing cap and tie bar connections between the housing and the housing caps. Advantageously, the tie bars can be hydraulically stressed or prestressed for the operating state of the rollstand. The individual parts of the stand are thus prestressed by means of hydraulically elongated or extended tie bars. The rollstand is therefore provided with the stretch characteristics of an undivided rollstand.

The extension force and therefore the elongation of the tie bar for releasing or stressing the tie bar was hitherto produced by hydraulic means and a screwthreaded nut was then screwed down for maintaining the tie bar in the extended and stressed state. This operation was performed manually or—in a more costly manner—by a hydraulically actuated ratchet drive. In this method, after tightening of the screwthreaded nut, the hydraulic pressure applied by the hydraulic extending device for the tie bars is discharged. To release the screwthreaded nut the extending device is again biased by hydraulic pressure medium and the screwthreaded nut is turned upwardly until the tie bar can be pivoted outwardly beyond the housing edge.

Operation of the four screwthreaded nuts on each rollstand is awkward and time-consuming because the screwthreaded nuts, normally situated in the support sleeve of the hydraulic ring cylinder, can be actuated only through a slot in the support sleeve.

It is the object of the invention to save the installation times required for extending and slackening the tie bars and therefore to reduce the time required for roll changing in such rollstands so as to provide further mechanization.

To solve the problem it is proposed that the pressure medium which produces the prestressing forces can be supplied to or shut off from the tie bar heads of one or more rollstands through central means and the prestressing pressure continues to be applied to the tie bar head during rolling operation.

In a further embodiment of the invention and independent of relieving the prestressing pressure, the tie bars of one or more rollstands can be pivoted outwardly together through central control, by means of hydraulic power.

One embodiment of the invention is illustrated in the accompanying drawing, in which.

Figure 1:
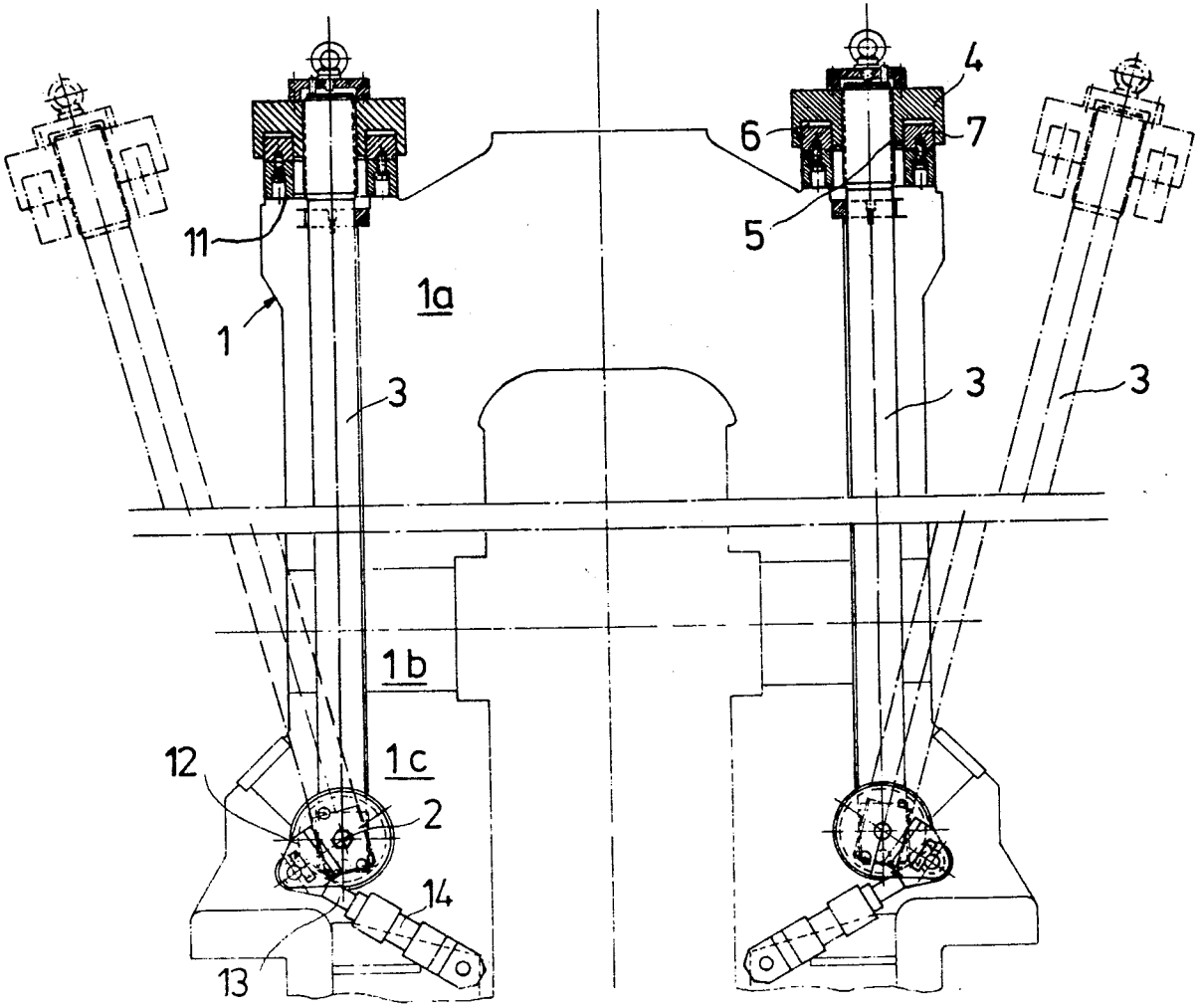
FIG. 1 shows a roll housing of divided construction with tie bars.
Figure 2:
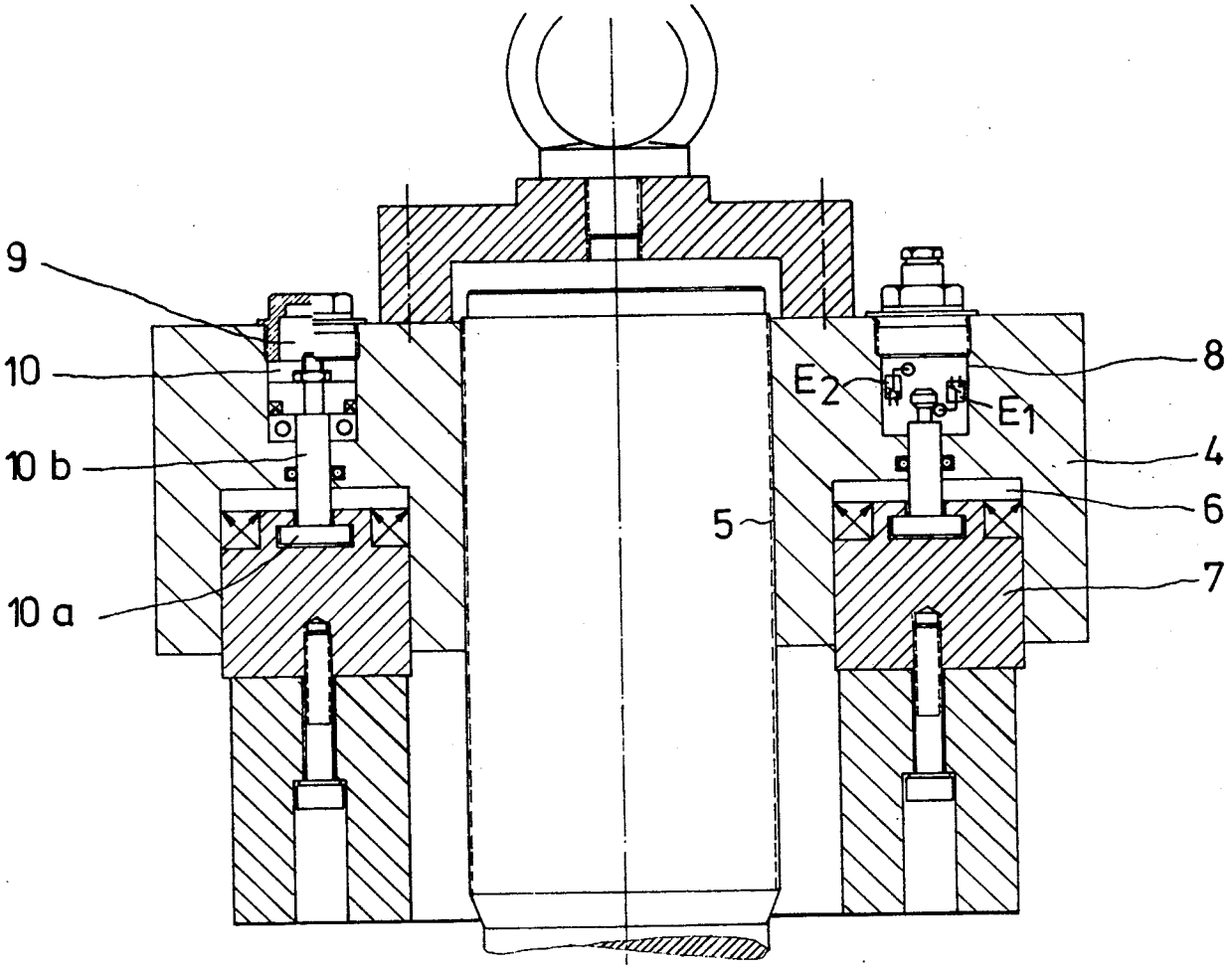
FIG. 2 shows an enlarged view of the tie bar head.
Figure 3:
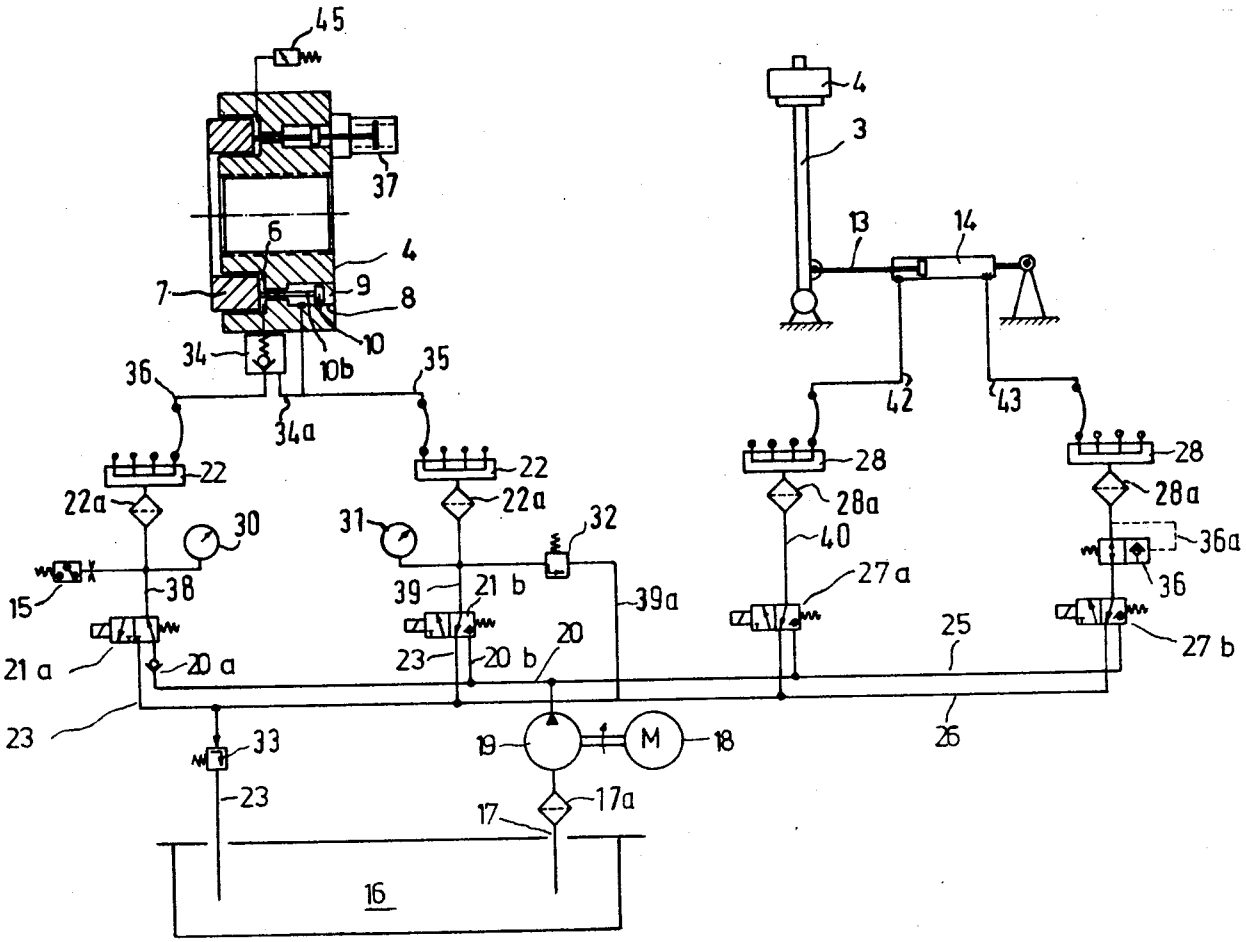
FIG. 3 shows the hydraulic control circuit for extending or relaxing and for outward pivoting of the tie bars.

In FIGS. 1 to 3, the numeral 1 refers to a roll housing comprising a top cross-member 1*a* which can be removed in the upward direction, an insertable vertical roll frame 1*b* as the middle piece and a bottom housing part 1*c*. Depending on whether the middle piece 1*b* is inserted or removed, the roll housing 1 can be used as a universal stand or as a two-high stand frame. The housing cheeks have recesses into which tie bars 3 are inserted which can be pivoted about pivot axes 2.

According to FIG. 2, the top ends of the top bars 3 have hydraulic stressing nuts 4 by means of which the tie bars 3 can be extended by biasing them with hydraulic medium and the housing parts 1*a*, 1*b* and 1*c* can be prestressed or stressed into one unit. The hydraulic stressing nuts 4 are mounted by means of internal screwthreading 5 on the ends of the tie bars 3 and have a bottom annular cylinder part 6 in which an annular piston 7 is slidably guided in the vertical plane. A plurality of retraction units 8 are inserted into the stressing nuts 4 and retraction pistons 10 are slidably guided in the vertical plane in the cylinder chambers 9 of said retraction units, the head part 10*a* of the piston rods 10*b* associated with the retraction pistons 10 being inserted in recesses of the annular piston 7. The annular pistons 7 bear on brackets 11 of the housing cheeks of the housing part 1*a*.

The tie bars 3 can be laterally pivoted out of the housing cheeks about axes 2. Bell cranks 12 are non-rotationally mounted on the pivot axes 2 in the bottom housing part 1*c* and piston rods 13 of hydraulic jacks 14, which can be biased from both sides, are hinged to the free ends of the said bell cranks.

FIG. 3 shows in diagrammatic form the hydraulic control system for biasing the hydraulic stressing nuts 4, mounted in the heads of the tie bars 3, and for outward pivoting of the tie bars 3 of the rollstand or stands 1.

A suction duct 17 extends from a pressure medium tank 16 via an oil filter 17*a* to a pressure medium pump 19, which is driven by a motor 18, and to a pressure medium duct 20, each branch 20*a*, 20*b* of which extends via electromagnetic spool valves 21*a*, 21*b* and via oil filters 22*a* to a distributor block 22. Each distributor block 22 has four connections for pressure medium ducts 35, 36 because four tie bars 3, each having a stressing nut 4, stress the top cross-member 1*a* with the roll frame 1*b* and the bottom housing part 1*c* of the universal rollstand, or only with the bottom housing part 1*c* in the case of a two-high stand, into a unit. The connection of only one stressing nut 4 to the distributor block 22 is illustrated since the connections between the distributor blocks 22 and the remaining prestressing nuts 4 are constructed in identical manner. The pressure medium duct 35 extends to the cylinder chamber 9 of the return piston 10 and the pressure medium duct 36 is connected through a controlled non-return valve 34 to the cylinder chamber 6 of the annular piston 7. The control duct 34*a* of the controlled non-return valve 34 is connected to the pressure medium duct 35 so that the non-return valve 34 is vented when the return piston 10 is operated. The annular piston 7 and the return piston 10 are associated with a pressure relay 37 which operates the pump 10 or its motor 18 in the case of leakage losses until the pressure drop in the cylinder chamber 6 is once again equalized. The numeral 45 refers to a pressure limiting valve which operates as safety valve and reduces the excess pressure in the cylinder chamber 6 by discharging the pressure medium in the event of failure of an adjustable pressure switch 15, which can be adjusted to the pressure in the cylinder chamber 9 corresponding to the desired prestressing forces of the tie-bars. A pressure indicator 30 is connected to the pressure medium duct 38. A further pressure indicator 31 and a pressure limiting valve 32, functioning as safety valve, is provided in the pressure medium duct 39, 39*a*. When the relevant electromagnetic spool valve 21*a* or 21*b* is changed over to discharge, a return duct 23 returns the pressure medium through a pressure limiting valve 33, functioning as safety valve, into the pressure medium tank 16.

The hydraulic piston/cylinder units 14 are connected to the pressure medium supply 16 to 19 through a pressure medium duct 25 and a return duct 26, parallel with the pressure medium duct 20 and the return duct 23. One electromagnetic spool valve 27*a* leads to a distributor head 28 through a feed duct 40 and an oil filter 28*a*, and another spool valve 27*b* leads to the distributor head 28 through feed duct 41 and controllable stop valve 36 with pilot duct 36*a* and an oil filter 28*a*.

Each of the distributor heads 28 is again provided with four duct connections, each for hydraulic jacks 14 for inward pivoting and lateral outward pivoting of the four tie-bars 3 which are associated with each rollstand 1. The numerals 42 and 43 refer to the pressure medium feed or discharge to and from the distributor heads 28 and the cylinder chamber ends associated with the hydraulic pressure means. The tie-bars 3 are outwardly pivoted for the purpose of roll changing. In the interests of simplicity only one totally enclosed pressure medium circuit from the distributor heads 28 to the hydraulic power means 14 is shown because the other three circuits extending from the distributor heads 28 are constructed in identical manner.

The method of operation of the system is as follows:

Pressure medium, which will normally be hydraulic fluid, is pumped by operation of the motor 18 and of the hydraulic fluid pump 19 coupled therewith from the pressure medium tank 16 via the oil filter 17*a* in the suction duct 17 and the pressure medium duct 20 into the duct branches 20*a* and 20*b* to elongate the tie-bars 3 and therefore to prestress the roll housing. Since only the electromagnetic spool valve 21*a* is open for the pressure medium in the pressure medium duct 20*a*, the said pressure medium is supplied through the duct 28 to the oil pressure gauge 30 and to the pressure switch 15, which is adjusted to the prestressing pressure of the tie-bars 3, and is simultaneously supplied through the oil filter 22*a* to the distributor head 22. From there, the pressure medium is supplied, as shown for one stressing nut 4, to the remaining three stressing nuts 4 of the rollstand via the three indicated additional connections on the distributor head 22.

The pressure medium passes through the duct 36 and through the controlled non-return valve 34 into the cylinder chamber 6 of the hydraulic stressing nut 4 in the head part of the tie-bar 3. The tie-bars 3 are elongated and the roll housing 1 is prestressed since the stressing nuts 4 bear firmly by means of screwthreading on the head parts of the tie-bars 3 and the annular pistons 7 bear on the housing sides of the rollstand 1. The motor 18 and therefore the pump 19 is shut down when the pressure in the cylinder chamber 6 reaches the value which is preset by means of the pressure limiter 15. The non-return valve 34 closes and the pressure of the pressure medium is retained at the preselected level during operation of the rollstand or rollstands 1.

If the pressure diminishes due to leakage losses, the motor 18 and therefore the pump 19 is switched on through the electric pressure relay 37 and pressure medium is supplied to the cylinder chamber 6 until the motor 18 and the pump 19 are again shut down through the pressure limiter 15. The pressure limiter 45 functions as a safety valve if the pressure limiter 15 fails.

To change the rolls the pressure medium in the cylinder chamber 6 of the stressing nuts 4 is returned to the pressure medium tank 16 through the pilot duct 34*a* via the pressure medium duct 36 and 38 and the return duct 23 by operation of the controlled non-return valve when the electromagnetic spool valves 21*a* and 21*b* are reversed while pressure medium flows via the pressure medium duct 20*b*, via the reverse control valve 21*b* and via the pressure medium ducts 39 and 35 to the cylinder chamber 9 so that the annular piston 7 is returned by means of the piston rod 10*b* of the auxiliary piston 10 into the position nearest to said auxiliary piston 10 and the head of the tie-bars 3 is thus released to enable it to be pivoted out of the housing sides of the roll housing 1. After the electromagnetic spool valve 27*a* is switched to pressure medium feed, the pressure medium is supplied through the pressure medium duct 25 via the pressure medium duct 40 and the oil filter 28*a* to the distributor head 28 and is conducted from there to each of the differential cylinders 14 which are associated with the four tie-bars 3 of each rollstand 1. Loading of the piston, which is guided in the cylinder 14, causes the piston rod 13 to be pushed back and causes the tie-rod 3 to be pivoted out of the roll housing 1 so that the top cross-member 1*a* can be lifted off in the upward direction to enable the rolls to be changed.

After fitting of the new rolls and replacing of the top cross-member 1*a*, the tie-bars 3 are again pivoted inwardly into the lateral slots of the housing sides of the roll housing 1 by changing the control valve 27*b* to pressure medium feed into the other part of the cylinder chamber of the cylinder 14 whereupon the control valve 27*a* is changed over to pressure medium discharge. The piston which is guided in the cylinder 14 is therefore loaded by pressure medium from the other side via the pressure medium duct 41, the stop valve 36, the oil filter 28*a* and the distributor head 28 as well as the pressure medium duct 43. Accordingly, the tie-bar 3 is again pivoted through the piston rod 13 into the operative position. The stop valve 36 can be adjusted to a specific pressure and on reaching the preset pressure it automatically connects its non-return valve via the pilot duct 36*a* into the pressure medium duct 41 so that the supply of pressure is interrupted.

With the control valve 27*a* reversed into the pressure medium discharge state, the pressure medium is returned via the pressure medium ducts 42, 40 and 26 from the other part of the cylinder chamber of the cylinder 14 into the pressure medium tank 16.

The limit switch $E_2$ blocks operation of the spool valves 27*a* and 27*b* and therefore blocks operation of the piston which is guided in the cylinder 14 for outward pivoting of the tie-bar 3, for as long as the auxiliary piston 10 has not moved the annular piston 7 into its top position, thus permitting the outward pivoting motion of the tie-bar 3.

The limit switch $E_1$ blocks operation of the spool valve 21*b* for as long as the auxiliary piston causes the annular piston 7 to bear on the brackets 11 of the rollstand 1.

In this way and by avoiding the manual work normally involved with conventional hydraulic pressure nuts in the tie-bars, it is possible for the tie-bars of one or more rollstands of a rolling mill to be simultaneously relaxed and to be pivoted laterally out of the roll housings 1 so as to be subsequently initiate the operation of lifting the top cross-member 1*a* for changing the rolls. This step can be applied to an individual roll housing 1 or to all roll housings of a rolling mill and this operation can be centrally controlled. After the rolls are changed and the top cross-member 1*a* has been replaced, the fully mechanically controlled procedure for inward pivoting of the tie-bars 3 and for prestressing or stressing the parts of the rollstand is repeated in the manner already described.

The advantage of the apparatus described is that it is possible to dispense with resetting of the screwthreaded nut of the hydraulically pre-extended tie bar or to dispense with slackening of the screwthreaded nut when the pre-extended tie bar is relaxed so that all manual work associated with prestressing and releasing the tie bars is obviated combined with simplification and a reduction of costs of the construction because the relatively expensive hydraulic screw threaded nut with ratchet device normally provided on the tie bar head is eliminated, thus leading to further savings in terms of construction.

I claim:

1. A roll housing for a rolling mill, said housing comprising a base, a separate top cross-member, a plurality of tie bars pivotally mounted in the base and extending through vertical open-sided slots in the base and in the top cross-member, an hydraulic stressing nut at the top of each tie bar which nuts can be pressurized to pull the base and top cross-member together to tension the tie bars and stress the housing, an hydraulic jack at the lower end of each tie bar which jacks can be pressurized to swing the tie bars into and out of engagement with the top cross-member when they are not tensioned, an hydraulic circuit for selectively pressurizing said nuts and said jacks and switching means in said circuit for switching said circuit between a first state wherein the mill is operational and wherein the stressing nuts are constantly pressurized to maintain the tie bars in a stressed condition and a second state wherein the hydraulic jacks are pressurized to swing the tie bars out of or into engagement with the top cross-member.

2. The roll housing of claim 1, and wherein each hydraulic stressing nut comprises a lower face having an annular cylindrical space, an annular piston biassed by pressure medium slidably guided in said space to abut the top cross-member, and retraction units associated with the annular piston for retracting the piston on pressure relieving the tie rods.

3. A rolling mill train comprising a number of roll housings as claimed in claim 1, and a common hydraulic circuit arranged between all the housings, for stressing and swinging out of the tie bars simultaneously for all the tie bars on all the housings.

* * * * *